US006461497B1

(12) United States Patent
Pedersen

(10) Patent No.: US 6,461,497 B1
(45) Date of Patent: Oct. 8, 2002

(54) REFORMULATED REDUCED POLLUTION DIESEL FUEL

(75) Inventor: Michael J. Pedersen, Irvine, CA (US)

(73) Assignee: Atlantic Richfield Company, Chicago, IL (US)

( * ) Notice: Subject to any disclaimer, the term of this patent is extended or adjusted under 35 U.S.C. 154(b) by 0 days.

(21) Appl. No.: 09/145,189

(22) Filed: Sep. 1, 1998

(51) Int. Cl.[7] ..... C10L 1/04
(52) U.S. Cl. ..... 208/15; 585/1; 585/14; 44/300
(58) Field of Search ..... 585/1, 14; 208/15; 44/300

(56) References Cited

U.S. PATENT DOCUMENTS

| | | | | | |
|---|---|---|---|---|---|
| 3,110,662 | A | | 11/1963 | Scott, Jr. et al. | 208/88 |
| 3,619,407 | A | | 11/1971 | Hendricks et al. | 208/48 R |
| 3,620,962 | A | | 11/1971 | Pfefferle | 208/89 |
| 3,667,152 | A | | 6/1972 | Eckert | 44/58 |
| 3,691,063 | A | | 9/1972 | Kirk, Jr. | 208/91 |
| 3,723,296 | A | | 3/1973 | Hahn | 208/89 |
| 3,761,395 | A | | 9/1973 | Child et al. | 208/89 |
| 3,923,638 | A | | 12/1975 | Bertolacini et al. | 208/89 |
| 4,039,477 | A | | 8/1977 | Engelhard et al. | 252/441 |
| 4,073,626 | A | | 2/1978 | Simmons | 44/57 |
| 4,159,257 | A | | 6/1979 | Engelhard et al. | 252/441 |
| 4,199,326 | A | | 4/1980 | Fung | 44/51 |
| 4,274,835 | A | | 6/1981 | Jordan | 44/1 SR |
| 4,378,973 | A | | 4/1983 | Sweeney | 44/56 |
| 4,411,768 | A | | 10/1983 | Unger et al. | 208/59 |
| 4,415,436 | A | * | 11/1983 | Angevine | 208/89 |
| 4,446,248 | A | | 5/1984 | Simpson et al. | 502/211 |
| 4,447,315 | A | | 5/1984 | Lamb et al. | 208/99 |
| 4,536,190 | A | * | 8/1985 | Seemuth | 44/57 |
| 4,540,483 | A | | 9/1985 | Simpson et al. | 208/216 PP |
| 4,547,285 | A | | 10/1985 | Miller | 208/89 |
| 4,568,449 | A | | 2/1986 | Angmorter et al. | 208/215 |
| 4,618,412 | A | | 10/1986 | Hudson et al. | 208/59 |
| 4,643,820 | A | * | 2/1987 | Zarrineghbal et al. | 208/222 |
| 4,645,585 | A | * | 2/1987 | White | 208/58 |
| 4,661,120 | A | | 4/1987 | Carr et al. | 44/57 |
| 4,664,677 | A | | 5/1987 | Dorer, Jr. et al. | 44/68 |
| 4,711,713 | A | | 12/1987 | Zarrineghbal et al. | 208/222 |
| 4,723,963 | A | | 2/1988 | Taylor | 44/57 |
| 4,746,420 | A | | 5/1988 | Darian et al. | 208/222 |
| 4,775,460 | A | | 10/1988 | Reno | |
| 4,781,729 | A | | 11/1988 | Bidwell | 44/57 |
| 4,810,356 | A | | 3/1989 | Grootjans et al. | 208/59 |
| 4,828,676 | A | | 5/1989 | Sawyer et al. | 208/57 |
| 4,846,959 | A | * | 7/1989 | Kennedy et al. | 208/97 |
| 4,857,073 | A | | 8/1989 | Vataru et al. | 44/57 |
| 4,902,405 | A | | 2/1990 | MacLean et al. | 208/59 |
| 4,920,691 | A | | 5/1990 | Fainman | 44/57 |
| 4,921,595 | A | | 5/1990 | Gruia | 208/59 |
| 4,931,165 | A | | 6/1990 | Kalnes | 208/100 |
| 4,954,241 | A | | 9/1990 | Kukes et al. | 208/59 |
| 4,992,605 | A | | 2/1991 | Craig et al. | 585/240 |
| 5,004,480 | A | | 4/1991 | Kanne | 44/387 |
| 5,023,221 | A | | 6/1991 | Occelli | 502/66 |
| 5,114,433 | A | | 5/1992 | Dubreux et al. | 44/322 |
| 5,114,434 | A | | 5/1992 | Praulus et al. | 44/322 |
| 5,210,347 | A | * | 5/1993 | Chen et al. | 585/14 |
| 5,258,049 | A | * | 11/1993 | Liotta, Jr. et al. | 44/324 |
| 5,316,658 | A | * | 5/1994 | Ushio et al. | 208/216 R |
| 5,389,111 | A | * | 2/1995 | Nikanjam et al. | 44/300 |
| 5,389,112 | A | * | 2/1995 | Nikanjam et al. | 44/300 |
| 5,792,339 | A | * | 8/1998 | Russell | 208/15 |
| 5,976,201 | A | | 11/1999 | Barry et al. | 44/413 |
| 6,004,361 | A | | 12/1999 | Barry et al. | 44/413 |

OTHER PUBLICATIONS

"BP Hydrocracks for Middistillates" by L. Alcock, R. Martin, K.H. Bourne, W.A. Peet, and J. Winsor, *The Oil and Gas Journal,* Jul. 8, 1974.

"High Quality Diesel by Hydrocracking" by Milan Skripek, D.A. Lindsay and K.E. Whitehead, Unocal Corporation, Brea, California, Presented at the 1988 National Petroleum Refiners Association Annual Meeting Mar. 20–22, 1988.

"Hydrocracking for High Quality Distillates" by Alain P. Lamourelle, Unocal Corporation, Brea, California, and Mark Reno and Gregory Thompson, UOP, Des Plaines, Illinois; Presented at the 1991 National Petroleum Refiners Association Annual Meeting Mar. 17–19, 1991.

"Investigation on the Effects of Fuel Composition and Injection and Combustion System Type on Heavy–Duty Diesel Exhaust Emissions" by Terry L. Ullman, Southwest Research Institute; Prepared for The Coordinating Research Council, Inc., Atlanta, Georgia; CRC Contact CAPE 32–80, Project VE–1; Mar. 1989.

"Study of Fuel Cetane Number and Aromatic Content Effects on Regulated Emissions From a Heavy–Duty Diesel Engine" by Terry L. Ullman, Roger L. Mason and Daniel A. Montalvo, Southwest Research Institute; Prepared for The Coordinating Research Council, Inc., Atlanta, Georgia; CRC Contract No. VE–1, Project VE–1; Sep. 1990.

(List continued on next page.)

*Primary Examiner*—Nadine Preisch
(74) *Attorney, Agent, or Firm*—F. Lindsey Scott; Scott P. McDonald

(57) ABSTRACT

A reformulated diesel fuel meeting the requirements of ASTM D975-96*a* for a low-sulfur number 2 diesel fuel and providing reduced emission benefits relative to a certified diesel fuel, certified under Section 2282(g) Title 13, California Code of Regulations and containing less than 15 volume percent aromatics having a natural cetane number of at least 55, a sulfur content less than 15 ppmw, a nitrogen content less than 10 ppmw, a polycyclic aromatics content no greater than 1.5 weight percent and an initial boiling point of at least 350° F. and a method for producing and using the reformulated diesel fuel.

21 Claims, 1 Drawing Sheet

OTHER PUBLICATIONS

"1993 Annual Book of ASTM Standards", Section 5 Petroleum Products, Lubricants, and Fossil Fuels: vol. 05.02; Publication Code No. (PCN): 01–050293–12; ASTM, Philadelphia, Pennsylvania, No month.

"Development of the First CARB Certified California Alternative Diesel Fuel" by Manuch Nikanjam, Chevron Research and Technology Company; SAE Technical Paper Series 930728; SAE International Congress & Exposition, Detroit, Michigan, Mar. 1–5, 1993.

"Effects of Fuel Aromatics, Cetane Number, and Cetane Improver on Emissions from a 1991 Prototype Heavy–Duty Diesel Engine" by Terry L. Ullman, Robert L. Mason and Daniel A. Montalvo, Southwest Research Institute; SAE Technical Paper Series 902171; International Fuels and Lubricants Meeting and Exposition, Tulsa, Oklahoma, Oct. 22–25, 1990.

* cited by examiner

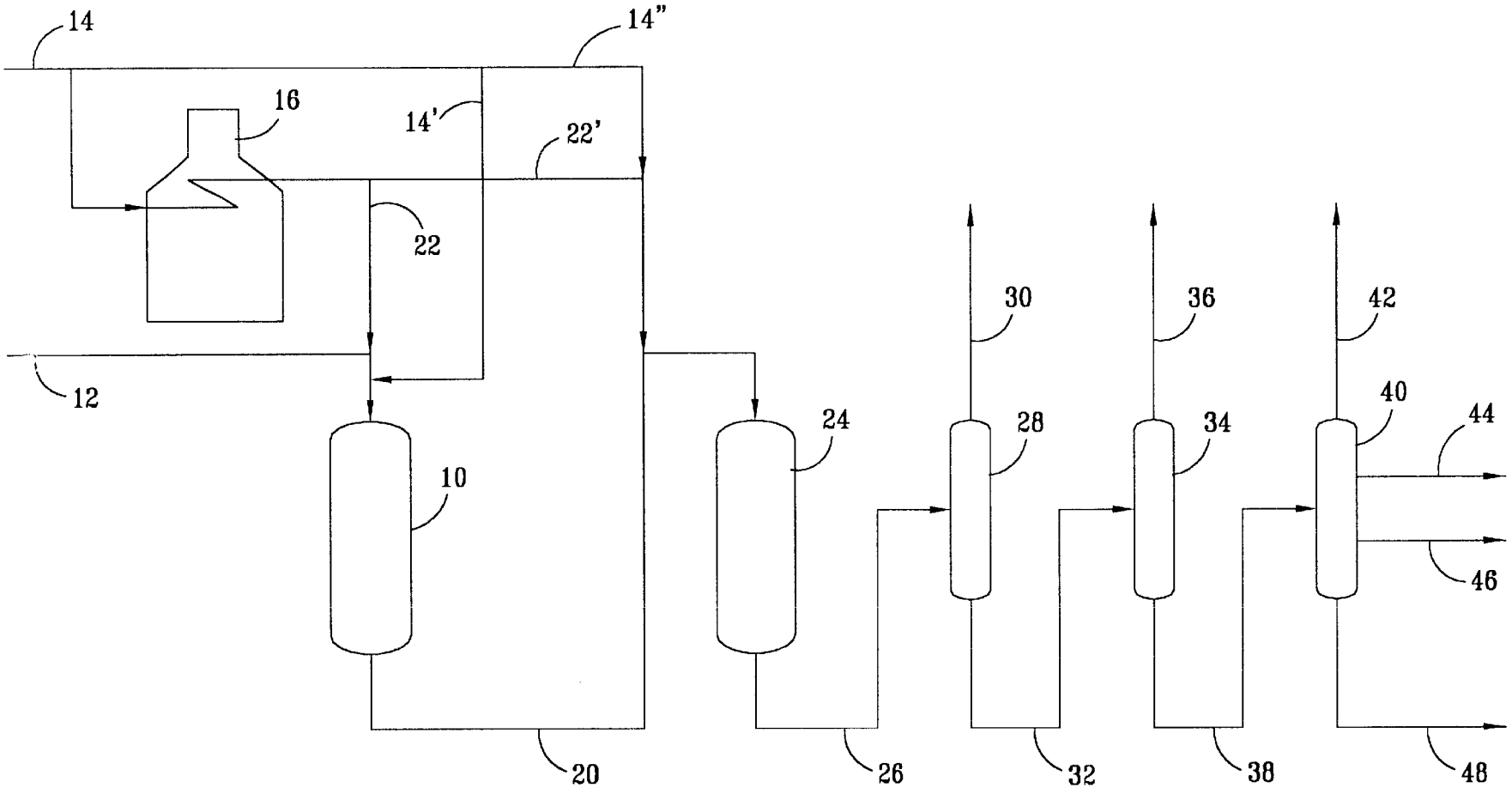
PRIOR ART

REFORMULATED REDUCED POLLUTION DIESEL FUEL

BACKGROUND OF THE INVENTION

1. Field of the Invention

This invention relates to a reformulated diesel fuel meeting the requirements of ASTM D975-96a and providing significantly reduced emissions by comparison to a certified diesel fuel, certified under Section 2282, Title 13, California Code of Regulations.

2. Description of the Related Art

Federal and state legislative bodies and agencies have issued a number of rules applicable to the production of clean diesel fuel in attempts to reduce emissions from heavy-duty vehicles of $NO_x$, carbon monoxide, unburned hydrocarbons, and particulate matter. Diesel fuel properties given the most attention are cetane number, aromatics content, and sulfur content. Federal regulations, for instance, require vehicular diesel fuel sold beginning Oct. 1, 1993 to have a maximum sulfur content of 0.05 percent and a minimum cetane index of 40 or a maximum aromatics content of 35 percent.

Some states have issued more demanding requirements. For example, the California Air Resources Board ("CARB") has adopted Section 2282, Title 13, California Code of Regulations ("Section 2282") which limits the aromatic hydrocarbon content of diesel fuel sold or intended for sale as a motor vehicle fuel in California starting Oct. 1, 1993.

Section 2282 establishes a basic California statewide aromatic hydrocarbon limit for vehicular diesel fuel of 10 percent by volume with a less stringent 20 percent standard for small refiners and a temporary 20 percent standard for independent refiners.

Sections 2282(a)(1)(C) and 2282(g) allow diesel fuel producers and importers to comply with the regulation with a set of diesel fuel specifications of their choosing if they can demonstrate that the alternative specifications result in emission benefits at least equivalent to the emission benefits resulting from a 10 volume percent aromatic hydrocarbon standard (or, in the case of small refiners, the 20 percent aromatic hydrocarbon standard) reference fuel.

Section 2282(g) identifies a test procedure for comparative testing of a candidate fuel and a reference fuel representative of a diesel fuel with 10 percent aromatic hydrocarbons (or 20 percent by volume for small refiners) as specified in Section 2282(g) involving back-to-back tests using a specified heavy-duty diesel engine and identifies the statistical methodology to be used in comparing the emissions of $NO_x$, particulate matter, and the soluble organic fraction of the particulate matter resulting from the two fuels, and establishes a process for certifying diesel fuel formulations that satisfy the regulatory criteria.

The reference fuel is defined as shown in Table I.

TABLE 1

Reference Fuel Specifications

| Property | ASTM Test Method* | General Reference Fuel Specifications | Small Refiner Reference Fuel Specifications |
|---|---|---|---|
| Sulfur Content | D2622-82 | 500 ppm max. | 500 ppm max. |
| Aromatic Hydrocarbon Content, Vol. % | D1319-84 | 10% max. | 20% max. |
| Polycyclic Aromatic | D2425-83 | 1.4% max. | 4% max. |

TABLE 1-continued

Reference Fuel Specifications

| Property | ASTM Test Method* | General Reference Fuel Specifications | Small Refiner Reference Fuel Specifications |
|---|---|---|---|
| Hydrocarbon Content, Wt. % | | | |
| Nitrogen Content | D4629-86 | 10 ppm max. | 90 ppm max. |
| Natural Cetane Number | D613-84 | 48 minimum | 47 minimum |
| Gravity, API | D287-82 | 33–39 | 33–39 |
| Viscosity at 40°, cSt | D445-83 | 2.0–4.1 | 2.0–4.1 |
| Flash point, ° F., (min.) | D93-80 | 130 | 130 |
| Distillation, ° F. | D86-82 | | |
| IBP | | 340–420 | 340–420 |
| 10% REC. | | 400–490 | 400–490 |
| 50% REC. | | 470–560 | 470–560 |
| 90% REC. | | 550–610 | 550–610 |
| EP | | 580–660 | 580–660 |

*The listed ASTM methods are incorporated herein by reference.

Exhaust emission tests using the candidate fuel and the reference fuel shall be conducted in accordance with the "California Exhaust Emission Standards and Test Procedures for 1985 and Subsequent Model Heavy-Duty Diesel-Powered Engines and Vehicles," as incorporated by reference in Title 13, California Code of Regulations, Section 1956.8(b). The tests shall be performed using a Detroit Diesel Corporation. Series-60 engine, or, if the executive officer determines that the Series-60 is no longer representative of the post-1990 model year heavy-duty diesel engine fleet, another engine found by the executive officer to be representative of such engines.

Section 2282(g)(1) requires that an applicant for certification submit to the Executive Officer of CARB for approval a proposed test protocol which includes detailed information on the entity proposed to conduct the tests, the test procedures, analytical test data on the candidate and reference fuels, the quality control and quality assurance procedures, and identification of any statistical outlier tests to be used. The same section also provides procedures for applicants to submit a certification application which includes the approved test protocol, all of the test data, a copy of the complete test log, and a demonstration that the candidate fuel meets the requirements for certification.

If the Executive Officer of CARB finds that the candidate fuel has been properly tested and meets the performance criteria, an Executive Order certifying the diesel fuel formulation will be issued which assigns an identification name to the specific certified diesel fuel. The Order must specify that the certified diesel fuel formulation has the following specifications: (1) a sulfur content, a total aromatic hydrocarbon content, a polycyclic aromatic hydrocarbon content, and a nitrogen content not exceeding that of the candidate fuel; (2) a cetane number not less than that of the candidate fuel; and (3) presence of all additives that were contained in the candidate fuel in a concentration not less than in the candidate fuel, except for an additive demonstrated by the applicant to have the sole effect of increasing cetane number.

Prior to Oct. 1, 1993, many refiners in California were marketing diesel fuels which contained 35% or more aromatics. The aromatics were considered to cause a problem in the diesel fuel emissions and CARB indicated that the lower aromatics content of 10% or less was an attempt to reduce diesel fuel particulates and $NO_x$ emissions. While CARB imposed a limit of 10 volume percent, it has developed that many refiners marketed and continue to market diesel fuels which contain in excess of 20 volume percent aromatics as a result of the alternative fuel certification process. In other words, diesel fuels having an aromatics content much higher than 10 volume percent have been prepared, tested as required by CARB against the 10% aromatics reference fuel, and certified with a much higher aromatics content.

S.I.R. H1553 "Clean Diesel Fuel and Methods of Producing Clean Diesel Fuel", published Jul. 2, 1996 by Michael J. Pedersen, is hereby incorporated in its entirety by reference. This publication discloses a method for producing a clean diesel fuel and discloses in Example 3 the preparation of two test diesel fuels D-25 and D-26 which were prepared as described in the application, and which were subsequently certified by CARB. The certification numbers for these fuels are Executive Order G-714-007 and Executive Order G-714-008. The properties of these fuels are disclosed at column 15, at lines 6–22. The test results of the standardized combustion tests for certification are shown in Tables 3 and 4 in column 17. It will be noted that these fuels have aromatic contents of 21.7 volume percent and 24.7 volume percent, respectively.

U.S. Pat. No. 5,792,339 "Diesel Fuel", issued Aug. 11, 1998 to Robert L. Russell and assigned on its face to Tosco Corporation, is hereby incorporated in its entirety by reference. This reference discloses, in Table 3 in column 4, the properties of two diesel fuels which are the subject of the claimed invention, two ARCO fuels shown as ARCO D-25 and D-26, three Chevron fuels shown as Chevron D-4781, F-2 and G-2, and one Texaco fuel. Upon observation of these fuels, it is noted that these fuels have aromatic contents varying from 15 weight percent up to 24.7 weight percent. These fuels also contain sulfur in amounts from less than 5 parts per million by weight (ppmw) up to 496 ppmw. The fuels also include polycyclic aromatics in an amount equal to from about 1.9 to about 8.6 weight percent. The nitrogen contents vary from 20 to 1050 ppmw and the minimum cetane number varies from about 50.7 up to about 59.

It will be observed that many of these fuels contain undesirable materials in relatively large quantities. For instance, most of the fuels contain quantities of aromatics well in excess of 10 volume percent. Many of the fuels also contain large amounts of sulfur and nitrogen. This serves to direct attention to the fact that the CARB regulations are directed to the requirements for a reference fuel, but there are few limitations upon the amount of polluting materials which may be contained in the candidate fuel so long as the emissions during the standardized test procedure are equivalent to or less than those generated by the reference fuel mandated by CARB. For instance, please note in U.S. Pat. No. 5,792,339, that whereas the CARB specifications for the reference fuel are shown in Table 1 and contain certain distillation requirements, the properties of the TF-1 and TF-3 fuels in Table 2 at column 3 have initial boiling points lower than permitted in the test fuel, Ten volume percent distillation temperatures lower than permitted in the test fuel, aromatics much higher than are permitted in the reference fuel, polycyclic aromatics much higher than permitted in the reference fuel, nitrogen much higher than permitted in the reference fuel and, in the TF-3, an end point higher than permitted in the test fuel. This serves to emphasize that the fuels which may be marketed under CARB certifications have little in common with the requirements for the reference fuel. As a result, it is possible to legally market fuels in California under a CARB certification, such as those shown in U.S. Pat. No. 5,792,339, which contain over 450 ppmw sulfur, over 20 weight percent aromatics, over 6 weight percent polynuclear aromatics, and as high as 1050 ppmw of nitrogen. These fuels clearly contain substantial quantities of many materials considered to be precursors to undesirable pollutants. Not surprisingly, fuels which are legally marketable under CARB regulations still result in the emission of visible and odorous pollutants from diesel-powered vehicles. This problem has been particularly pronounced in urban areas where deliveries to local retail establishments and the like via diesel-powered vehicles place the diesel-powered vehicles in close proximity to living areas, work areas and areas frequented for purposes of shopping and the like.

Recently, there has been an increased effort to eliminate or limit the use of diesel fuel in delivery trucks and other vehicles in urban areas. Not only are the exhausts from diesel engines unsightly, and in many instances odorous, they may constitute a health hazard. Accordingly, it would be desirable if a cleaner-burning diesel fuel could be developed for use in urban areas.

SUMMARY OF THE INVENTION

According to the present invention, a reformulated diesel fuel meeting the requirements of ASTM D 975-96a for a low-sulfur No. 2 diesel fuel and providing reduced emission benefits relative to a certified diesel fuel, certified under Section 2282, Title 13, California Code of Regulations, is provided. The reformulated diesel fuel contains less than 15 volume percent aromatics and has a natural cetane number of at least 55; a sulfur content less than 15 ppmw; a nitrogen content less than 10 ppmw; a polycyclic aromatics content no greater than 1.5 weight percent; at least about 14 weight percent hydrogen, and an initial boiling point of at least 350° F. Desirably, the reformulated diesel fuel includes less than 12 volume percent aromatics and preferably less than 10 volume percent aromatics.

The reformulated diesel fuel may be produced by a process comprising charging a diesel fuel range feedstock having a boiling range from about 250 to about 790° F (ASTM D-2887) to a hydrotreating zone with added hydrogen in the presence of a hydrotreating catalyst at conditions effective to convert at least a portion of the organo-nitrogen and organo-sulfur compounds to hydrocarbons, ammonia and hydrogen sulfide, to produce a hydrotreater effluent stream; charging at least a portion of the hydrotreater effluent stream to a hydrocracking zone with added hydrogen in the presence of a hydrocracking catalyst at conditions sufficient to produce a hydrocracking zone effluent containing a gasoline range fraction and a diesel fuel range fraction and fractionating the hydrocracking zone effluent to separate the gasoline fraction and produce the diesel fuel product. The feedstock contains aromatics in an amount and of a type such that, after processing in the hydrotreating zone and in the hydrocracking zone, the aromatics content is reduced to the desired level in the resulting diesel fuel product. Similarly, the sulfur content, polynuclear aromatics content, nitrogen content and material types are controlled in the feedstock so that after processing in the hydrotreating zone and in the hydrocracking zone, the contents of the sulfur, polynuclear aromatics and nitrogen are within the limits specified above for the reformulated diesel fuel.

The reformulated diesel fuel is useful in a method for reducing pollution resulting from the combustion of a CARB certified diesel fuel in diesel-powered ground transportation vehicles and other diesel-powered equipment by fueling such vehicles and equipment with the reformulated diesel fuel.

BRIEF DESCRIPTION OF THE DRAWINGS

The FIGURE is a schematic diagram of a process suitable for the production of the diesel fuel of the present invention.

DESCRIPTION OF THE PREFERRED EMBODIMENTS

According to the present invention, a reformulated diesel fuel, which meets the requirements ox ASTM D975-96a for a low-sulfur number 2-D diesel fuel and provides significantly reduced emissions relative to a certified diesel fuel certified under Section 2282, Title 13, California Code of Regulations, is provided. The reformulated fuel has a natural cetane number of greater than 55, a sulfur content less than 15 ppmw, and a polycyclic aromatics content no greater than 1.5 weight percent. The fuel has an aromatics content less than about 15 volume percent, a nitrogen content less than about 10 ppmw and an initial boiling point of at least 350° F. and preferably contains no cetane enhancer.

Various cetane enhancers are commercially marketed and used to increase the cetane of diesel fuels. Many of these cetane improvers, such as ethyl hexyl nitrate, contain significant quantities of nitrogen and may have some toxicity. Nitrogen oxides which are generated upon the combustion of such nitrogen-containing cetane improvers are generally considered to be an undesirable environmental pollutant. Non-combusted cetane improvers in diesel emissions may constitute a toxic emission and contribute to the formation of particulates.

The fuel of the present invention has a low sulfur content which is suitably less than 15 ppmw but is preferably less than 10 ppmw and desirably less than about 5 ppmw. The combustion of fuels containing sulfur compounds results in the production of undesirable particulate emissions. CARB has recently determined that the particulates in diesel emissions are toxic. Sulfur also has a detrimental effect on diesel engine after-treatment devices such as catalytic converters. Accordingly, the sulfur content of the present fuel is low.

The content of polycyclic aromatics in the present fuel is also very low. Typically, the polycyclic aromatics content is no greater than about 1.5 weight percent and is desirably from about 0.1 to about 1.45 weight percent. Even more desirably, the polycyclic aromatic content is less than 1.0 weight percent. The presence of polycyclic aromatic materials is considered to result in the emission of undesirable particulates and uncombusted hydrocarbons. Accordingly, the polycyclic aromatic content is low.

To ensure desirable combustion, the cetane number of the fuel is greater than 55. Desirable results are also achieved when the cetane number is greater than 56; 57; 58; 59; 60 or higher.

The fuel desirably has an initial boiling point of at least about 350° F. Preferably, the boiling point is from about 375 to about 390° F. It is desirable that the initial boiling point be sufficiently low so that good combustion is accomplished.

The fuel desirably has a 10 volume percent boiling point of at least 430° F. and preferably from about 430 to about 450° F.

The fuel also desirably has a 90 volume percent boiling point of at least 590° F. and desirably from about 590 to about 640° F. and preferably from about 590 to about 610° F. It is desirable to have a substantial amount of higher boiling material in the fuel to provide suitable fuel efficiency when the fuel is combusted.

The fuel of claim 1 has an aromatics content less than 15 volume percent. Desirable results are also achieved with aromatic contents less than 14 volume percent; 13 volume percent; 12 volume percent and 11 volume percent. Desirably, the fuel of the present invention has an aromatics content less than about 10 volume percent. The other fuel composition criteria discussed previously are also desirably maintained with the fuels containing less than 10 volume percent aromatics. The fuel may contain less than 9 volume percent; 8 volume percent; 7 volume percent; 6 volume percent; 5 volume percent or less aromatics.

The fuel of the present invention results in reductions of hydrocarbons, carbon monoxide and particulates emissions greater than 5 percent and normally greater than 10 percent by comparison to a certified fuel. The fuel also results in significant reductions in $NO_x$, emissions by comparison to a certified fuel.

The fuel of the present invention may be readily formulated by those skilled in the art using refinery streams which contain suitable diesel fuel components with sufficiently low quantities of the materials discussed above.

As noted previously, many of the fuels currently marketed as certified fuels in California contain substantial quantities of materials which are generally considered to be precursors to environmental pollutants in the emissions from diesel engines. For instance, in U.S. Pat. No. 5,792,339, previously incorporated by reference, various fuels are referred to. Particularly, attention is directed to fuels TF-1 and TF-3 as shown in column 4 which contain up to 487 and 496 ppmw sulfur, respectively. These fuels also contain 23.9 and 23.3 weight percent aromatics, respectively, 6.3 and 8.6 weight percent polycyclic aromatics, respectively, and 893 and 1050 ppmw nitrogen, respectively. By contrast, the fuel of the present invention is designed to contain much lower quantities of these materials and to emit reduced quantities of pollutants, especially visible and odorous pollutants upon combustion.

Recent studies have indicated that diesel fuel emissions may represent serious health hazards. Further, diesel fuel emissions are becoming increasingly objectionable in urban areas where deliveries are made to retail establishments and other establishments where individuals come into contact with the diesel fuel emissions. Accordingly, it is desirable that a reformulated diesel fuel such as described above be available for use in such areas.

The reformulated diesel fuels are readily formulated by those skilled in the art using refinery streams which contain reduced quantities of the materials discussed above.

One process for the production of such fuels is disclosed in S.I.R. H1553 "Clean Diesel Fuel and Methods of Producing Clean Diesel Fuel", published July 2, 1996 by Michael J. Pedersen.

An embodiment of the process disclosed in H1553, previously incorporated herein by reference, is shown in the FIGURE. In the FIGURE, a diesel fuel range feedstream is charged to a hydrotreater 10. The feedstream is charged via a feedstream line 12. Hydrogen is supplied through a line 14 to a heater 16. The heated hydrogen is passed via a line 22 and the feedstream in line 12 is passed to hydrotreater 10. The feedstream in line 12 may be a blend of feedstocks mixed to achieve a feedstream having selected properties. Similarly, a portion of the hydrogen may be added to the feedstream without heating via a line 14' if desired. It should also be understood in the discussion of the process that the hydrogen may be introduced at a plurality of points along the length of hydrotreater 10, if desired. The feedstream desirably comprises a stream having diesel fuel properties including a boiling range from about 250 to about 790° F. In hydrotreater 10, the feedstream is contacted with a suitable catalyst in hydrotreater 10 at an inlet pressure in the range of about 1450 to about 2100 psig and more preferably in the range of about 1700 to about 1800 psig at a temperature in the range of about 550 to about 700° F. The outlet temperature is typically in the range of about 680 to about 780° F. The catalyst in hydrotreater 10 is a gasoline-selective catalyst as described in S.I.R. H1553. The remaining reactor conditions are considered to be known to those skilled in the art, as described in S.I.R. H1553. The hydrotreater effluent is passed via a line 20 to a hydrocracker 24. Additional heated hydrogen is added as required via a line 22' after heating in heater 16 or otherwise. As with hydrotreater 10, unheated hydrogen from a line 14" may be added as desired and the hydrogen may be optionally added at a plurality of locations along the length of hydrocracker 24. The operation of hydrocracker 24 is as described in S.I.R. H1553 and is considered to be known to those skilled in the art. The reactor effluent from hydrocracker 24 is recovered through a line 26 and passed to a high-pressure separator 28 where very light gases, such as hydrogen, are separated from the liquid stream and recovered via a line 30. The liquid stream is recovered as a bottom stream 32 and passed to a low-pressure separator 34 where very light gases are separated via a line 36 with the bottom stream being recovered through a line 38 and passed to a fractionator 40. In fractionator 40, a light hydrocarbon stream is recovered through a line 42, a lighter stream such as gasoline is recovered through a line 44, a heavier stream such as jet fuel is recovered through a line 46, and the diesel product is recovered through a line 48 as the bottom stream.

The operation of this process as described above is considered to be well-known to those skilled in the art. The fuel of the present invention is readily produced in such a process by adjusting the content of the feedstream to include aromatics, sulfur, nitrogen and polycyclic aromatics in an amount and of types such that, after treatment in the hydrotreater and hydrocracker, the amounts of these materials are reduced to the limits set forth above in the product diesel stream.

In addition to reducing the environmental pollutants introduced in the atmosphere upon combustion of the diesel fuel, the reformulated diesel fuel also provides these reductions with no reduction in fuel efficiency by comparison to a CARB certified diesel fuel.

While desirable results are achieved even with a single diesel engine using the reformulated diesel fuel of the present invention, the most effective results are achieved in reducing pollution resulting from the combustion of CARB certified diesel fuels by substituting the reformulated diesel fuel of the present invention for the CARB certified diesel fuel in a large number of diesel-powered vehicles. Desirably, the reformulated diesel fuel is delivered to a large number of distribution points over a wide geographic area and dispensed into diesel-powered vehicles so that a large number of diesel-powered vehicles are converted to use of the reformulated diesel fuel. The use of the reformulated diesel fuel in a large number of vehicles results in a greater reduction in pollution over a wide area. Desirably, quantities greater than about 100,000 gallons are delivered on an average daily basis over a one-week period of time for dispensing into diesel-powered vehicles.

The reference to the quantities of materials measured in the preceding discussion are made by reference to the standard test procedures referred to in the CARB specifications for the CARB test fuel.

Having thus described the invention by reference to its preferred embodiments, it is respectfully pointed out that the embodiments described are illustrative, rather than limiting, in nature and that many variations and modifications are possible within the scope of the present invention. Many such variations and modifications may be considered obvious and desirable by those skilled in the art based upon a review of the foregoing description of preferred embodiments.

What is claimed is:

1. A reformulated diesel fuel meeting the requirements of ASTM D975-96a for a low sulfur no. 2-D diesel fuel and providing reduced emission benefits relative to a certified diesel fuel certified under Section 2282(g) Title 13, California Code of Regulations, said fuel containing less than 11 volume percent aromatics and having:

a) a natural cetane number of greater than 55;

b) a sulfur content less than 15 ppmw;

c) a nitrogen content less than 10 ppmw;

d) a polycyclic aromatics content no greater than 1.0 weight percent; and e) an initial boiling point of at least 350° F.

2. The fuel of claim 1 wherein the fuel has a sulfur content less than about 10 ppmw.

3. The fuel of claim 2 wherein the fuel has a sulfur content less than about 5 ppmw.

4. The fuel of claim 1 wherein the fuel has a polycyclic aromatic content from about 0.1 to about 1.45 weight percent.

5. The fuel of claim 1 wherein the fuel has a cetane number of at least 57.

6. The fuel of claim 1 wherein the fuel has an initial boiling point from about 375 to about 390° F.

7. The fuel of claim 1 wherein the fuel has a 90 volume percent boiling point of at least 590° F.

8. The fuel of claim 1 wherein the fuel has a 90 volume percent boiling point from about 590 to about 640° F.

9. The fuel of claim 1 wherein the fuel has an aromatics content less than 5 volume percent.

10. The fuel of claim 1 wherein the fuel has a 10 volume percent boiling point of at least 430° F.

11. The fuel of claim 1 wherein the fuel has a 10 volume percent boiling point from about 430 to about 450° F.

12. The fuel of claim 1 wherein the cetane number is greater than about 58.

13. The fuel of claim 1 wherein the fuel has a cetane number of at least 56.

14. The fuel of claim 1 wherein the fuel has a 90 volume percent boiling point from about 590 to about 640° F.

15. The fuel of claim 1 wherein the fuel has an aromatics content from less than about 5 volume percent.

16. The fuel of claim 1 wherein the fuel has an aromatics content less than 9 volume percent.

17. The fuel of claim 1 wherein the fuel has an aromatics content less than 8 volume percent.

18. The fuel of claim 1 wherein the fuel has an aromatics content less than 7 volume percent.

19. The fuel of claim 1 wherein the fuel has an aromatics content less than 6 volume percent.

20. The fuel of claim 1 wherein the fuel has an aromatics content from about 9 to less than 11 volume percent, a sulfur content less than about 10 ppmw, and a polycylic aromatic content from about 0.1 to 1.0 weight percent.

21. The fuel of claim 1 wherein the fuel has an aromatics content from about 10 to less than 11 volume percent aromatics.

* * * * *